US005824183A

United States Patent [19]

Crankshaw

[11] Patent Number: 5,824,183

[45] Date of Patent: Oct. 20, 1998

[54] HIGH SPEED CORNER LABELER

[76] Inventor: Michael Crankshaw, 10119 Gridley Rd., Santa Fe Springs, Calif. 90670

[21] Appl. No.: 627,077

[22] Filed: Apr. 3, 1996

[51] Int. Cl.[6] ..... B65C 3/00; B65C 9/37; B65C 9/36; B65C 9/42

[52] U.S. Cl. ..... 156/486; 156/358; 156/391; 156/443; 156/580; 156/DIG. 5; 156/DIG. 41; 156/DIG. 42; 156/DIG. 45

[58] Field of Search ..... 156/486, 479, 156/480, 490, 475, 468, DIG. 24, DIG. 37, DIG. 42, DIG. 45; 53/389.05; 493/347, 382

[56] References Cited

U.S. PATENT DOCUMENTS

| | | | |
|---|---|---|---|
| 646,514 | 4/1900 | Wilson | 493/331 |
| 1,451,908 | 4/1923 | Htach | 493/382 |
| 1,467,021 | 9/1923 | Tzbides | 156/475 |
| 1,524,652 | 2/1925 | Hatch | 493/382 |
| 2,052,903 | 9/1936 | Stagmeier | 156/468 |
| 2,100,652 | 11/1937 | Shimer | 156/526 |
| 2,512,579 | 6/1950 | Long | 156/468 |
| 2,906,426 | 9/1959 | Fritzinger | 156/468 |
| 3,027,292 | 3/1962 | Rothenberger | 156/468 |
| 3,079,977 | 3/1963 | Larkin | 156/353 |
| 3,909,339 | 9/1975 | Verch | 156/486 |
| 4,124,429 | 11/1978 | Crankshaw | 156/364 |
| 4,314,869 | 2/1982 | Crankshaw | 156/215 |
| 5,209,808 | 5/1993 | Booth | 156/487 |
| 5,227,002 | 7/1993 | Faust et al. | 156/468 |
| 5,228,943 | 7/1993 | Vasilakes | 156/468 |
| 5,421,948 | 6/1995 | Crankshaw et al. | 156/486 |

*Primary Examiner*—Francis J. Corin
*Attorney, Agent, or Firm*—Donald E. Stout

[57] ABSTRACT

The inventive labeling device employs a vacuum belt transport having a motor-driven endless belt, for conveying a label from a proximal end to a distal end of the transport. Initially, a chute is disposed between the label dispenser and the vacuum belt transport, which is capable of receiving a label dispensed by the label dispenser and holding it until the vacuum belt transport returns to a label receiving position and can accept the new label. This combination of a vacuum belt transport and a chute allow the labeler to dispense a new label while the previous label is still being applied to an article, thereby greatly increasing the labeling capacity of the labeler.

22 Claims, 6 Drawing Sheets

FIG. 1
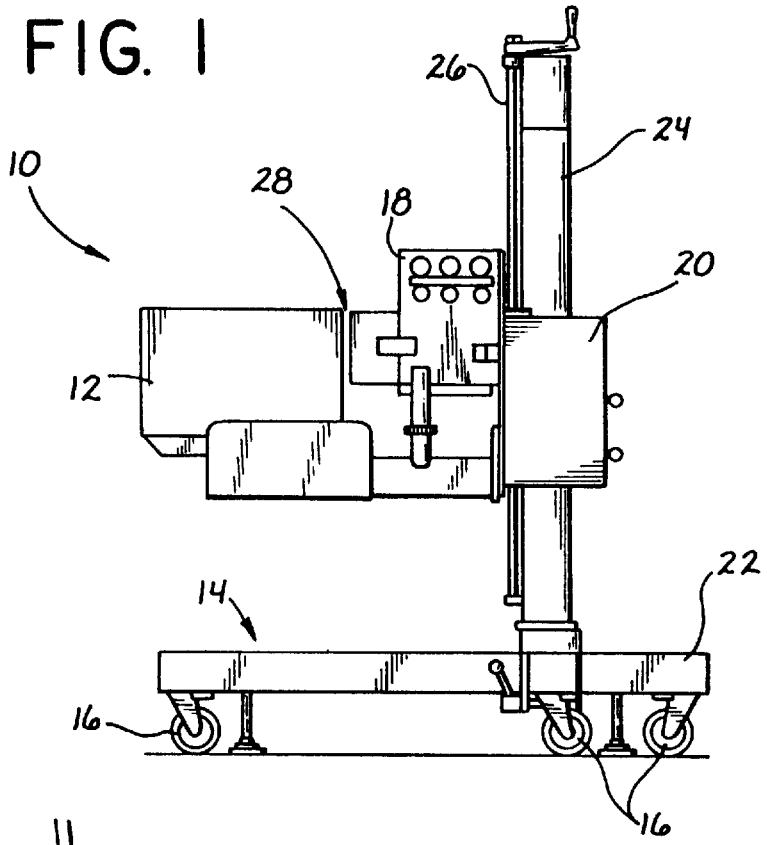
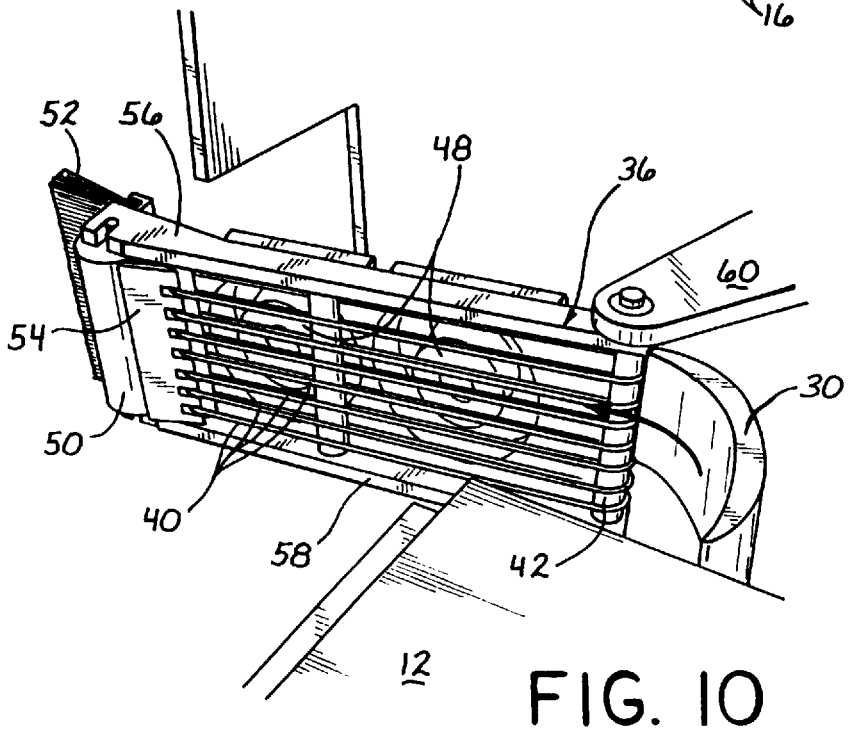
FIG. 10

52
50
36
10
66
13
38
48
34
65a
38
68
41
72
40
100
42
98
32
70
60
12
98
94
41
96
46
30
44
72
13
18

HIGH SPEED CORNER LABELER

BACKGROUND OF THE INVENTION

This invention relates generally to applicator systems for applying labels or the like to articles, and more particularly to label applicator systems for applying a label about a corner of a rectangular article, so that portions of the label adhere to each of the front and side faces of the article.

A typical label applicator applies one or more labels to an article as the article is conveyed past the label applicator. For example, a label applicator may dispense a label onto a label receiver which transfers the label to the article by tamping of the label against the article and/or by a blast of air under pressure.

It is sometimes necessary or desirable to apply a single label to multiple faces of an article. For example in the case of an article, such as a box, which is in the form of a rectangular solid it may be desirable to apply a label to the front face and the proximal side face of the box. In such a case, the label is adhered to the two faces of the box and wraps around the corner of the box.

Prior art techniques for accomplishing this typically include the use of a label carrier, for example in the form of a vacuum drum, which receives a label in a label receiving position, then moves to a label applying position to adhere the label to one face of the article, so that a first portion is adhered thereto and a second portion overhangs the other face of the article to be labeled. Then, a common approach is to use either the label carrier or a separate roller to adhere the overhanging portion of the label to the second article face. However, only after the label carrier has finished adhering one label to an article can it be returned to the label receiving position, upon which a second label can be dispensed from the label dispenser and the process repeated to label the next sequential article. As a result, a typical state of the art corner labeler of the type described is fairly slow, in one prior art embodiment having the capability to label only about seven articles per minute, for example.

SUMMARY OF THE INVENTION

This invention provides a label applicator and method which generally overcomes the disadvantages noted above with the prior art. With this invention a label can be accurately applied to the front and proximal side faces of an article, while attaining a dramatically increased labeling rate. For example, in one preferred embodiment, the labeling rate was increased to about sixteen articles per minute.

Generally, the inventive labeling device employs a vacuum belt transport having a motor-driven endless belt, for conveying a label from a proximal end to a distal end of the transport. Initially, an arcuate chute is disposed between the label dispenser and the vacuum belt transport, which is capable of receiving a label dispensed by the label dispenser and holding it until the vacuum belt transport returns to a label receiving position and can accept the new label. This combination of a vacuum belt transport and a chute allows the labeler to dispense a new label while the previous label is still being applied to an article, thereby greatly increasing the labeling capacity of the labeler.

More specifically, a high speed corner labeler is provided for applying labels to articles which are conveyed through a labeling station and have a front side, a proximal side, and a corner joining the front and proximal sides. The labeler includes a label dispenser for dispensing adhesive-backed labels for application to each of the articles and a label carrier having a label receiving position and a label applying position. The label carrier is adapted to apply a single label to the front and proximal sides of each article as it is conveyed through the labeling station, such that the label is wrapped about the corner. The label carrier includes a transport drive, preferably comprising a vacuum belt transport having first and second rollers and an endless belt extending around the rollers, for transporting each label from a proximal end to a distal end of the label carrier. One of the rollers comprises a drive roller which is motor-driven to rotatably drive the belt. A region of the endless belt between the rollers on one side of the rollers is adapted to receive labels to be applied to the articles. Means for providing vacuum pressure, preferably comprising vacuum fans, are provided for supplying vacuum pressure at the region of the belt on which the labels travel, to releasably retain the labels on the belt. The labeling station is disposed at the distal end of the label carrier. Advantageously, the label carrier is adapted to apply a first label to an article passing through the labeling station while simultaneously receiving a second label at the proximal end of the label carrier for application to the next sequential article to pass through the labeling station.

In another aspect of the invention, a high speed corner labeler is provided which comprises a label dispenser for dispensing adhesive-backed labels for application to articles conveyed through a labeling station, and a label carrier comprising a vacuum belt transport having first and second rollers and an endless belt extending around the rollers, wherein one of the rollers comprises a drive roller for rotatably driving the belt. A region of the endless belt between the rollers on one side of the rollers is adapted to receive labels to be applied to the articles. The vacuum belt transport includes a means for providing vacuum pressure at the region of the belt to hold labels on that belt region, and is supported by a shuttle frame.

Advantageously, an arcuate chute is disposed between the label dispenser and the label carrier, for receiving labels dispensed from the label dispenser and providing them to the label carrier. This chute smooths the transition for delivering labels from the label dispenser to the vacuum belt transport, and also functions to accept labels dispensed from the label dispenser, and to hold them temporarily when the label carrier is not immediately in position to receive additional labels.

The shuttle frame is pivotable between a home position and an armed position, and is also axially translatable between a retracted label receiving position, where a proximal end of the vacuum belt transport is closely adjacent to a distal end of the chute, for receiving a label from the chute, to an axially extended label applying position, wherein a distal end of said label carrier contacts a side of an article passing through said labeling station, to thereby apply a label to the article.

In addition to the ability of the chute to hold a dispensed label until the shuttle returns to its label receiving position, it is also possible for the vacuum belt transport to receive a label at its proximal end, while simultaneously applying a previous label to the side face of a passing article. This ability further increases the labeling rate of the labeler, as it is actually potentially possible for as many as two additional labels to be dispensed before a first label has been completely applied to an article.

Another advantageous feature of the invention is the simultaneous use of the axial retracting motion of the shuttle back to the label receiving position to also wipe down a first portion of a label onto the front face of an article. A wiping roller is disposed at the distal end of the label carrier, and functions to wipe the first label portion down as the shuttle frame retracts. Similarly, the pivoting motion of the shuttle frame as it returns to its home position, once it is axially retracted, due to an applied biasing force, simultaneously functions to wipe down a second portion of the label onto the proximal face of the article. A wiping brush is disposed at the distal end of the label carrier to perform this function. The ability to tamp down the label onto both article faces using motions required to return the shuttle frame into position to perform another labeling operation prevents the need to employ additional rollers or wiping motions, which would significantly slow the labeling rate of the apparatus.

In yet another aspect of the invention, a method of labeling articles having a front side, a proximal side, and a corner joining the front and proximal sides, wherein the articles are conveyed through a labeling station, is disclosed. The method includes the steps of providing a labeler having a label dispenser and a vacuum belt transport having a proximal end for receiving labels from the label dispenser and a distal end for applying labels to the articles, dispensing a first label from the label dispenser, and receiving the first label onto the proximal end of the vacuum belt transport. Additional steps include moving the first label from the proximal end of the vacuum belt transport to the distal end of the vacuum belt transport, by means of the rotating endless belt, applying a first portion of the first label to the front side of an article passing through the labeling station, and applying a second portion of the first label to the proximal side of the article. Significantly, the method further includes the step of dispensing a second label from the label dispenser while the first label is still being applied to the article.

In still another aspect of the invention, a method of labeling articles having a front side, a proximal side, and a corner joining the front and proximal sides, wherein the articles are conveyed through a labeling station, is disclosed which includes the step of providing a labeler having a label dispenser and a vacuum belt transport having a proximal end for receiving labels from the label dispenser and a distal end for applying labels to the articles, wherein the vacuum belt transport is supported by a shuttle frame. Additional method steps include dispensing a label from the label dispenser, and receiving the label onto the proximal end of the vacuum belt transport while the shuttle frame is in an axially retracted label receiving position. The shuttle frame is then axially translated to an extended label applying position, wherein the distal end of the vacuum belt transport is in the path of articles passing through the labeling station. The label is positioned at the distal end of the vacuum belt transport by means of the moving endless belt, and preferably extends about a wiping roller at the distal end of the vacuum belt transport, with its adhesive side facing the front side of an oncoming article to be labeled. The shuttle frame is then pivoted from a home position to an armed position responsive to contact of the front side of the article with the distal end of the vacuum belt transport, since as the article contacts the wiping roller, it continues to move forwardly on the conveyor system, thus pushing the shuttle frame pivotally. When the shuttle frame reaches its armed position, it contacts a switch, which in turn causes the shuttle frame to retract from the label applying position to the label receiving position. The axial retracting motion of the shuttle frame causes the distal end of the vacuum belt transport to adhere a first portion of the label to the front side of the article, since the wiping roller wipes down the first label portion as the shuttle frame retracts. Once the shuttle frame retracts sufficiently to no longer be contacted by the article, a biasing force causes the shuttle frame to pivotally return to the home position. This pivotal motion causes the distal end of the vacuum belt transport to adhere a second portion of the label to the proximal side of the article, as a wiping brush wipes down the label portion.

The invention, together with additional features and advantages thereof, may best be understood by reference to the following description taken in conjunction with the accompanying illustrative drawing.

BRIEF DESCRIPTION OF THE DRAWINGS

FIG. 1 is a side elevational view of a high speed corner labeling apparatus construction in accordance with the principles of the invention;

FIG. 10 is a perspective view illustrating the belt-driven label carrier of the present invention;

DETAILED DESCRIPTION OF THE DRAWINGS

Figure 2:
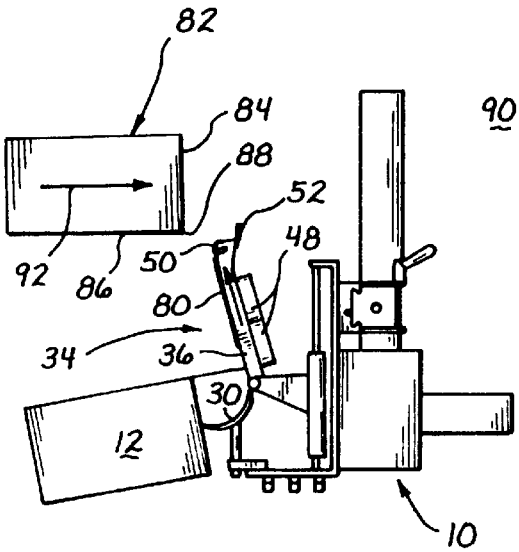
FIG. 2 is a top plan view of the apparatus shown in FIG. 1, illustrating the label carrier in its label receiving position as an object to be labeled approaches from the left side.

Referring now more particularly to the drawings, FIG. 1 illustrates in side elevation a high speed corner labeling apparatus 10 constructed in accordance with the principles of the invention. The label applicator 10 includes a suitable thermal transfer printer 12 of known construction, such as the PRODIGY PLUS model available from Datamax, Inc., for example, for printing and delivering discrete, customized, adhesive-backed labels for application to a desired article. The label applicator 10 is preferably supported on a platform 14 having a plurality of wheels 16 so that it is readily transportable to different application sites or to a storage area, as desired. A first electrical control panel 18 and a second pneumatic control panel 20 together control the operation of the label applicator 10. The platform 14 includes a base portion 22 and a vertical upstanding portion 24. The vertical upstanding portion 24 includes a guide rail 26 on which the label applying portion 28 of the label applicator 10 is supported, in a conventional manner permitting the height of the label applying portion 28 to be adjusted for adaptation to various labeling applications. The printer may be suitably pivotably mounted so that it is readily swung out and away from the remainder of the label applicator 10 for convenient servicing.

Figure 11:
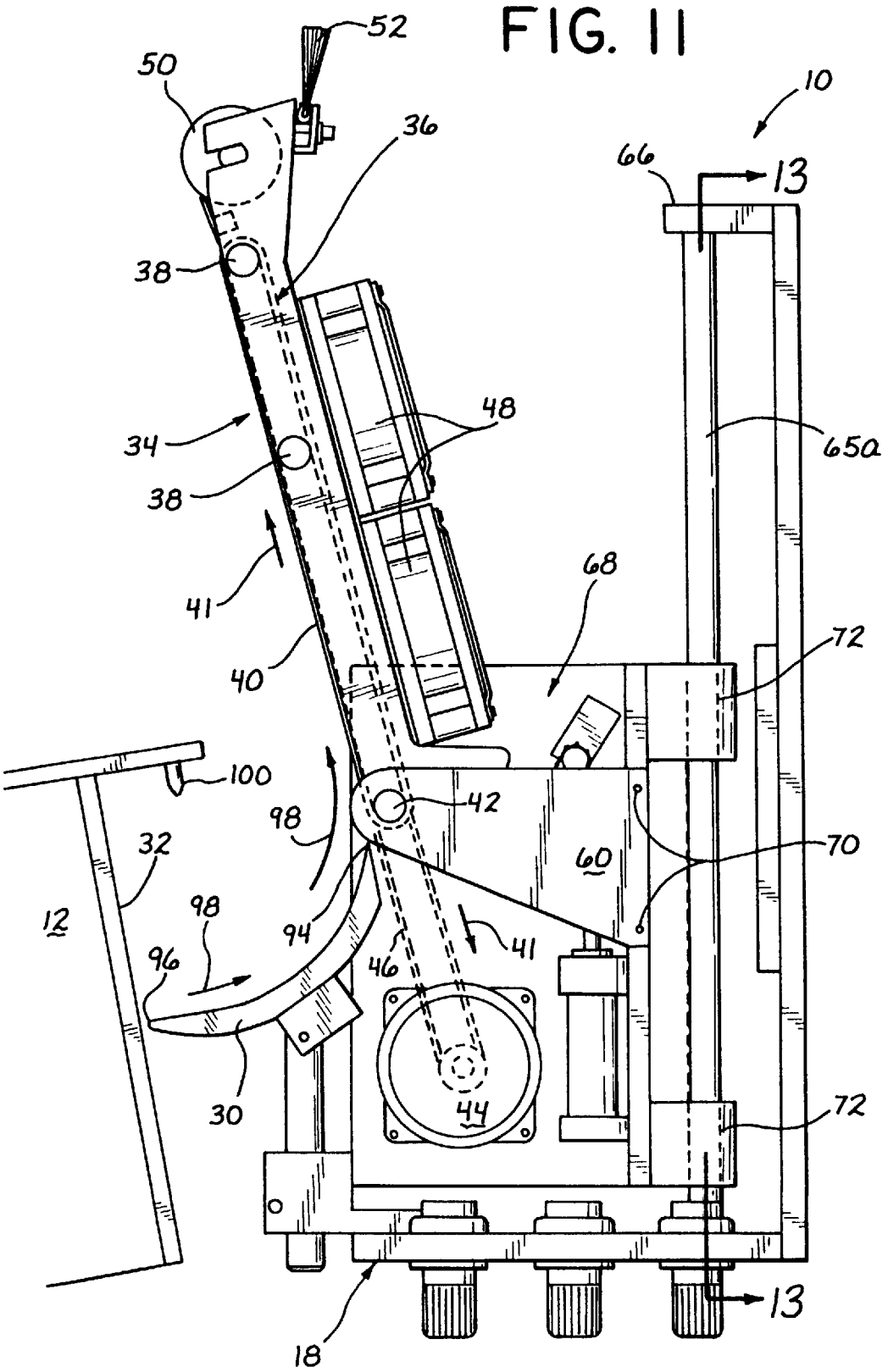
FIG. 11 is an enlarged top plan view of the label carrier shown in FIG. 10, illustrating the label carrier in the label receiving position shown in FIG. 2.
Figure 12:
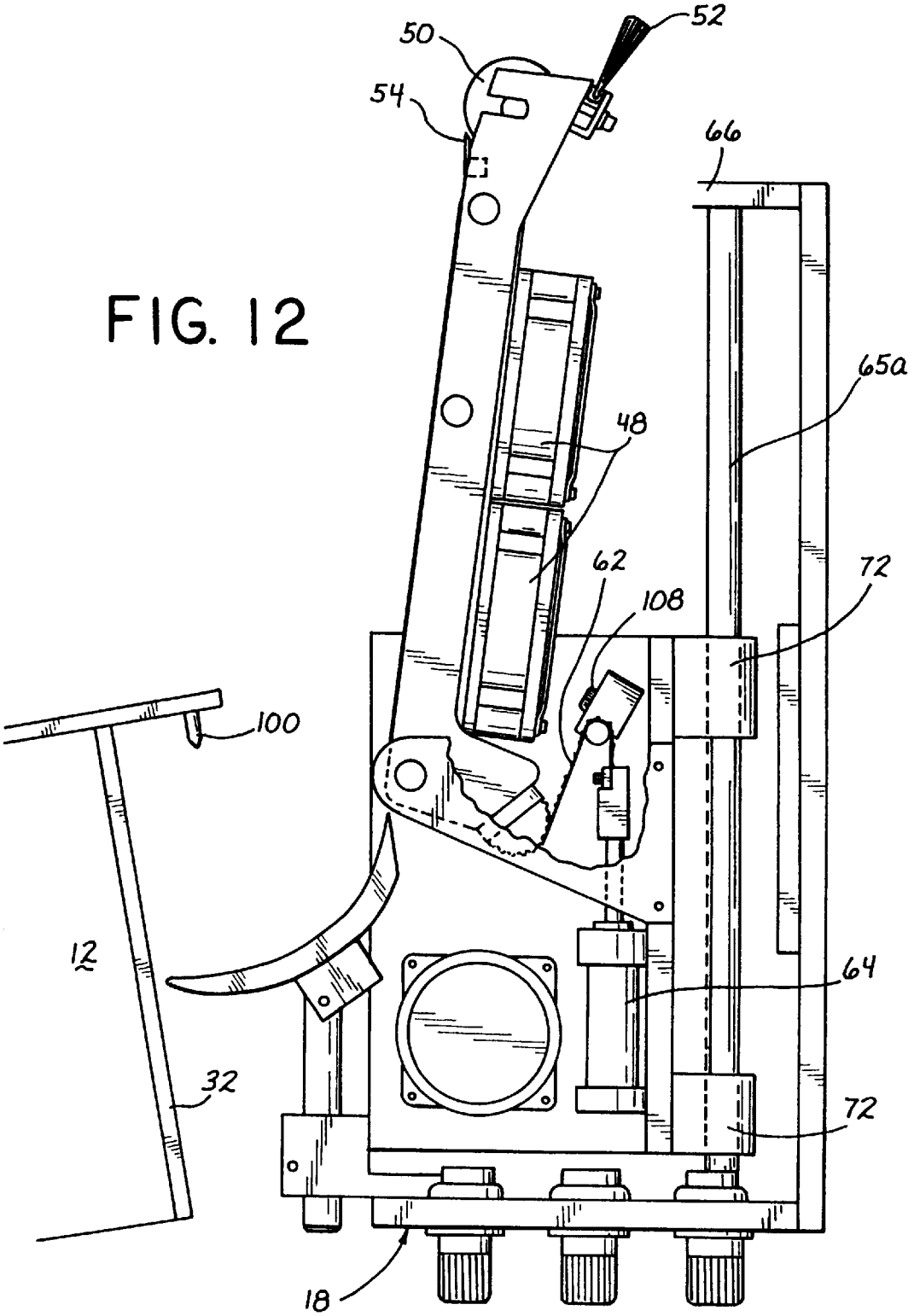
FIG. 12 is a top plan view similar to that shown in FIG. 11, illustrating the label carrier in the position shown in FIG. 6.

Referring now to FIGS. 10, 11, and 12, the label applicator 10 comprises a chute 30, which is preferably of an arcuate shape for receiving a label from the label dispenser 32 of the printer 12 and distributing it to a vacuum belt transport drive 34. The belt transport drive 34 is of a generally conventional construction and preferably comprises a shuttle frame 36 (best seen in FIG. 10) having a plurality of idler rollers 38 about which a plurality of endless, spaced belts 40 (FIG. 10) are rotatably driven, in the direction indicated by the arrows 41 (FIG. 11). The belts 40 are preferably constructed in known fashion of a tubular elastomeric oaring material, and are driven by means of a drive roller 42. The drive roller 42 may be variously driven, but in the preferred embodiment is driven by a stepper motor 44 via a belt 46. In the preferred embodiment, the belts are driven at a speed equal to the speed at which labels are dispensed from the printer 12 (typically 2 to 10 inches per second, depending on the printer model employed), while a label is being printed and dispensed, then, once the label has been dispensed and freed from its carrier (liner), the belts 40 are accelerated to a far greater speed in order to lessen the time for the label to traverse the length of the belt transport and reach the label applying position on its distal end.

In order to releasably retain a label on the belt transport drive 34, a plurality of vacuum fans 48 are disposed on the shuttle frame 36 to create a region of lower pressure behind the belts 40, so that the labels are drawn by the resultant pressure differential against the belts 40.

The distal end of the shuttle 36 includes a wiping roller 50, a wiping brush 52, and a scoop 54, which functions to transition a label being transported along the belt drive 34 from the belts 40 to the wiping roller 50, so that the label does not become entangled about the roller 50.

The shuttle frame 36 is comprised of upper and lower frame members 56 and 58, respectively. The distal end of each of the upper and lower frame members 56 and 58 is adapted to rotatably receive, using any conventional means (such as bushings, for example), an end of a shaft on which the wiping roller 50 is disposed, so that the roller 50 is fixedly yet rotatably held between the respective distal ends of each frame member 56, 58 (FIG. 10). The proximal end of the frame member 56 is pivotally attached to an upper support member 60, while the proximal end of the frame member 58 is similarly pivotally attached to a lower support member (not shown), which is preferably of a similar construction to that of the support member 60. Both the upper support member 60 and the lower support member together also rotatably support the drive roller 42.

Figure 6:
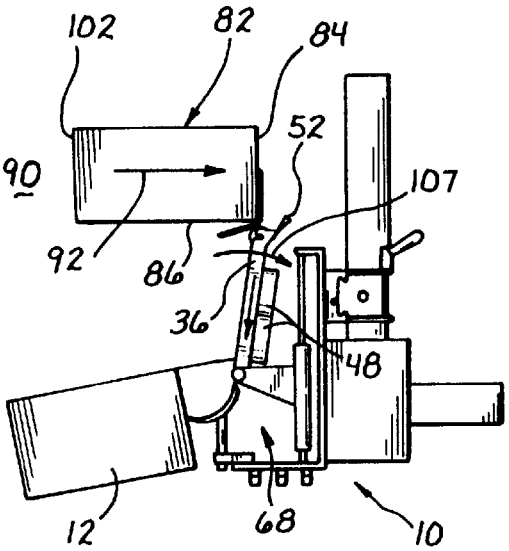
FIG. 6 is a top plan view similar to that of FIG. 5, illustrating the labeling apparatus of the invention with the label carrier in its fully retracted position and beginning to apply a second portion of the label to the proximal side of the object passing through the labeling station.

Because of the pivotable attachment between the proximal ends of each of the frame members 56 and 58 and the upper and lower support members, respectively, the shuttle 36 is pivotable between a home position shown in FIGS. 2 or 11, where the distal end of the shuttle is displaced to the left and an armed position shown in FIGS. 6 or 12, wherein the distal end of the shuttle is displaced to the right. In the presently preferred embodiment, as best shown in FIG. 12, the shuttle 36 is biased to the home position by means of a timing belt 62 driven by an air cylinder 64.

Figure 3:
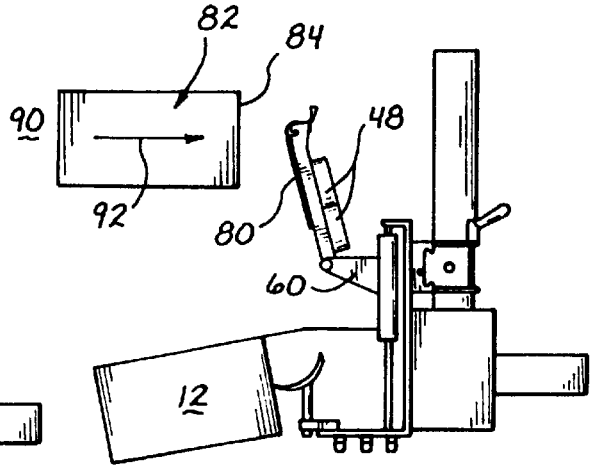
FIG. 3 is a top plan view similar to that of FIG. 2, illustrating the label carrier after it has been actuated to its label applying position, as the object to be labeled continues to approach from the left side.
Figure 13:
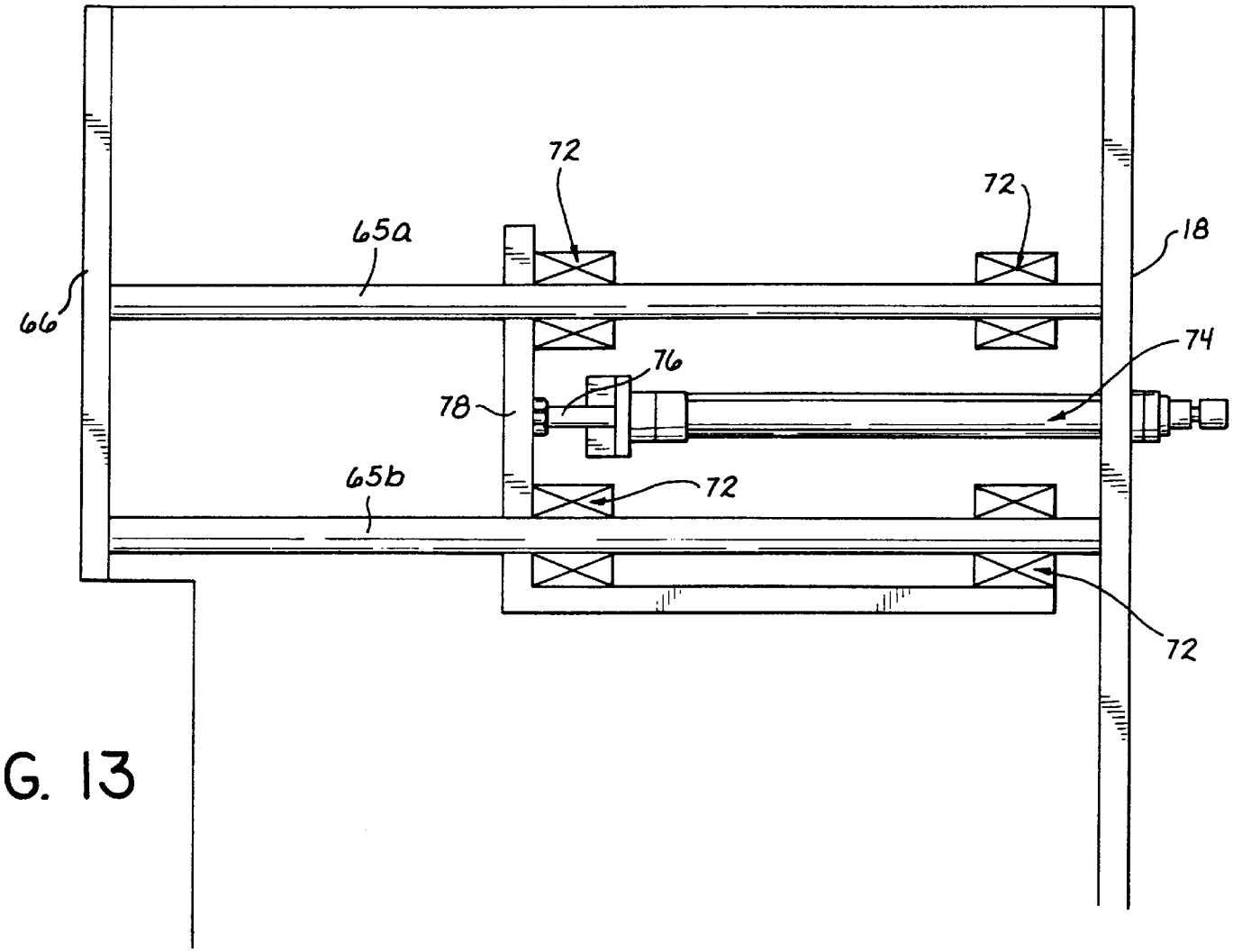
FIG. 13 is a cross-sectional view taken along lines 13—13 of FIG. 11, illustrating the actuating mechanism for the label carrier.

In addition to the pivoting motion described above and illustrated in FIGS. 11 and 12 (as well as in FIGS. 2–9, to be described more fully below), the shuttle 36 is also adapted to move between a retracted label receiving position (FIG. 2) and an extended label applying position (FIG. 3). In the preferred embodiment, a pair of rails 65*a* and 65*b* (FIG. 13) are provided which extend from the first control panel 18 distally to a distal wall member 66 (FIGS. 11–13). The shuttle 36 is attached to a carriage assembly 68 via the upper support member 60 and the lower support member (not shown), using, for example, mechanical fasteners 70 (FIG. 11). The carriage assembly is preferably slidably attached to the rails 65*a* and 65*b* by means of bearing assemblies 72 (FIGS. 11–13), so that the shuttle 36 may be extended and retracted relative to the printer 12 by axially sliding the bearing assemblies 72 distally or proximally along the rails 65*a*, 65*b*. A pneumatically driven axial drive cylinder 74, having a piston 76 attached to a cross-piece 78, which in turn is fixedly attached to the two distal bearing assemblies 72 (FIG. 13), is preferably employed to drive the carriage assembly 68 between its label-applying and label receiving positions, although other known actuation systems could also be utilized.

Referring now to FIGS. 2–9, operation of the preferred corner labeling invention will be described. FIGS. 2–9 illustrate in sequence the application of a label 80 to an article 82 having a front face 84, a side face 86, and a corner 88 joining the two faces 84 and 86. In a typical installation, the articles 82 travel along a conveyor system 90 in the direction of travel indicated by the arrows 92. As shown in FIG. 2, initially as an article 82 approaches the labeling apparatus 10, the shuttle 36 is in the position illustrated in FIG. 11; i.e. biased to the home position (pivoted to the left), by means of the timing belt 62 and air-driven cylinder 64, and retracted, so that the proximal end of the vacuum belt transport drive 34 abuts a distal end 94 of the chute 30. In this position, the belt transport drive 34 is ready to receive a label 80, which is dispensed from the label dispenser 32 (FIG. 11) of the printer 12 onto a proximal end 96 of the chute 30. The label 80, once received onto the chute 30, travels along the length of the chute in the direction of arrows 98, so that it passes from the distal end 94 of the chute 30 onto the proximal end of the belt transport drive 34. As shown in FIG. 2, the label 80 is in position at the distal end of the belt transport drive 34, ready to be applied to the approaching article 82. In the preferred embodiment, a pressurized air jet from an air assist nozzle 100 transfers the label 80 from the dispenser to the chute and holds it against the chute as the label traverses the length of the chute on its way from the printer 12 to the belt transport drive 34.

Once the label 80 is disposed on the proximal end of the belt transport drive 34, the rotating belts 40 are accelerated as discussed supra to quickly move the label 80 to the distal end of the belt transport drive 34. Alternatively, if simplification is desired, the belts 40 could be driven constantly. The adhesive side of the label 80 is exposed, while the printed side contacts the belts 40. The label is releasably retained against the belts 40 because of the pressure differential between the front and back sides of the belts 40 resulting from operation of the vacuum fans 48.

The inventive embodiment includes a sensor (not shown) which is adapted to detect the passing of a rear edge 102 of an article 82. When such an event is detected, the axial drive cylinder 74 (FIG. 13) is actuated to move the shuttle 36 to its extended label applying position.

In certain applications requiring maximum labeling speed, it may be desirable to accelerate the belts 40 to move the label from the proximal end to the distal end of the shuttle 36 while the shuttle is simultaneously in the process of extending to its label applying position, rather than first advancing the label and then extending the shuttle (in two separate steps), as is illustrated and discussed supra.

As illustrated in FIG. 3, as the front face 84 of an article 82 approaches the label applying station, the shuttle 36 should be fully axially extended into its label applying position. The extension limit of the shuttle 36 is adjustable depending upon the length of the label to be applied as well as the size of the article 82, so that it may be ensured that desired portions of the label will be applied to each of the front face 84 and side face 86 of each article.

Figure 4:
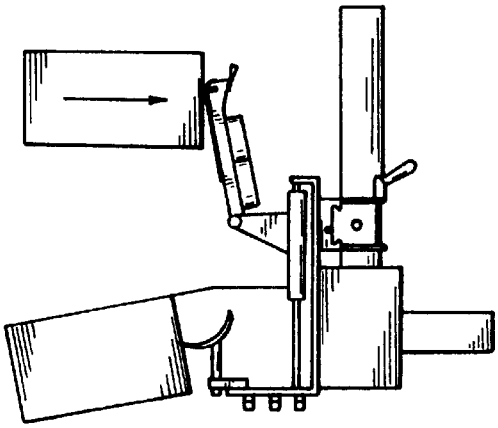
FIG. 4 is a top plan view similar to that of FIGS. 2 and 3, illustrating the label carrier as the front side of the object to be labeled contacts the label carrier and the adhesive side of a label to be applied to the object.

When the front face 84 of the article 82 contacts the wiping roller 50, as illustrated in FIG. 4, it contacts the adhesive side of the label 80 with its front face 84, so that a distal portion 104 (FIG. 5) of the label will adhere to the front face 84, with a proximal label portion 106 overhanging the article 82.

Figure 5:
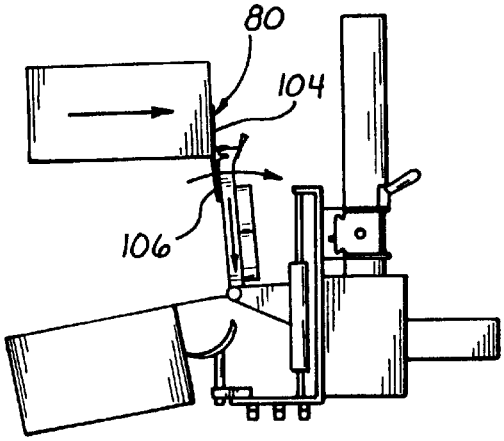
FIG. 5 is a top plan view similar to that of FIG. 4, illustrating the label carrier as it retracts back to the label receiving position, simultaneously applying a first portion of the label to the front side of the object.

Continued advancement of the article 82 along the conveyor 90 causes the shuttle 36, impacted by the front face 84 of the article 82, to be pushed so that it pivots against the bias of the timing belt 62, in the direction of arrow 107 in FIG. 5, to a rightward position illustrated in FIGS. 6 and 12. When the shuttle 36 reaches this armed position, a microswitch 108 (FIG. 12) is impacted by the shuttle frame. Actuation of the microswitch 108 in this manner causes the axial drive cylinder 74 to move the carriage assembly 68 very rapidly in a proximal direction, thereby retracting the shuttle 36 to its proximal label receiving position, as shown in FIGS. 5 and 6. This axial retraction motion further assists in applying the distal label portion 104 to the front face 84 of the article, as it causes the wiping roller 50 to tamp down the distal label portion on the article surface as it is retracted (FIG. 5).

Figure 7:
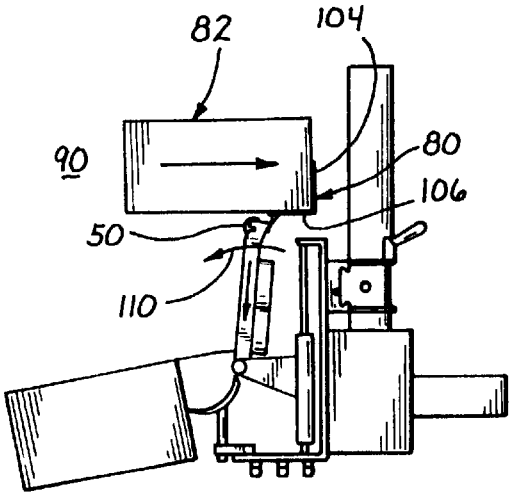
FIG. 7 is a top plan view similar to that of FIG. 6, illustrating the labeling apparatus as the label carrier pivots to its home position, thereby completing application of the second portion of the label to the proximal side of the object.

As the shuttle 36 is retracted to its label receiving position, the article 82 continues to move along the conveyor 90 past the label application station. Because the axial travel of the shuttle 36 is adjusted so that the distal end of the shuttle is approximately even with the position of the side face 86 of the article 82, as shown in FIGS. 6 and 7, the wiping brush 52 acts to tamp down the proximal label portion 106 onto the side face 86 of the article as it passes. Furthermore, once the shuttle 36 is retracted sufficiently far to clear the front face of the article 82, the biasing force of the timing belt 62 acts to pivot the shuttle 36 back to its home position, in the direction of the arrow 110 (FIG. 7). Advantageously, the pivoting motion of the shuttle arm 36 and the motion of the article 82 along the conveyor combine to perform the wiping action.

Figure 8:
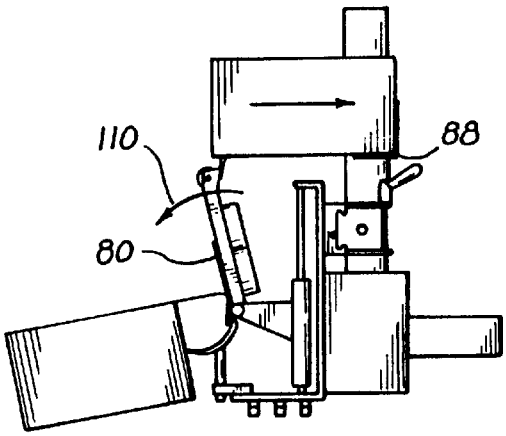
FIG. 8 is a top plan view similar to that of FIG. 7, with the label carrier fully in its label receiving position and a new label in labeling position on the label carrier.
Figure 9:
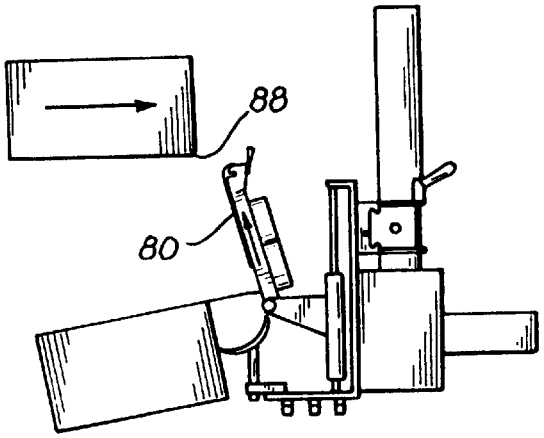
FIG. 9 is a top plan view identical to that of FIG. 2, illustrating the labeling apparatus in position to label the next approaching object.

In FIG. 8, the article 82 is illustrated as the labeling process is completed and the shuttle 36 has been returned to its home position with the the application roller 50 clear of the article. At this point, a new label 80 is fully dispensed from the printer 12 and is in the process of being transported along the vacuum belt. FIG. 9 illustrates the completion of the labeling cycle, and is substantially identical to FIG. 2, with the shuttle 36 fully extended, the new label 80 in the labeling position, and the next sequential article 82 approaching the labeling station from the left.

A significant advantage of the present invention is that immediately following the transfer of a label 80 from the chute 30 to the belt transport drive 34, another label may be dispensed by the label dispenser 32 onto the chute 30 and held there by the pressurized air jet from the air assist nozzle 100 until the shuttle 36 returns to the label receiving position and is capable of receiving the label. If the articles 82 are coming in rapid succession, the second label may be immediately transferred to the belt transport drive 34 as it returns to the retracted position, and there is no need to wait for application of the proximal label portion 106 to the side face 86 of the article. Another label may then be dispensed onto the chute at any time. Because of this unique feature, the inventive label applicator is capable of operating more than twice as fast as conventional corner labelers. For example, in one preferred embodiment, rather than the 7 articles per minute labeling capability of a successful conventional labeling unit, the inventive device is capable of labeling 16 articles per minute.

Although this invention has been described with reference to wrapping a label around the corner of an article, its use is not limited thereto. The invention is applicable to any kind of label application, and it is particularly applicable to label application techniques in which the application of a label delays the dispensing of the next label to be applied.

Although exemplary embodiments of the invention have been shown and described, it is to be understood that the invention is not limited thereto and that it can be variously practiced within the scope of the following claims.

What is claimed is:

1. A high speed corner labeler for applying labels to articles having a front side, a proximal side, and a corner joining said front and proximal sides, wherein said articles are conveyed through a labeling station, said labeler comprising:

a label dispenser for dispensing adhesive-backed labels for application to each of said articles; and a label carrier having a label receiving position and a label applying position, and being adapted to apply a single label to the front and proximal sides of each article as it is conveyed through said labeling station, such that the label is wrapped about said corner, the label carrier further including a transport drive for transporting each label from a proximal end to a distal end of said label carrier;

said labeling station being disposed at the distal end of the label carrier;

wherein the labeler is adapted so that a label may be dispensed from said label dispenser while another label is simultaneously being applied to an article passing through the labeling station, thereby increasing the labeling speed of the labeler.

2. The corner labeler as recited in claim 1, and further comprising a chute disposed between said label dispenser and said label carrier, for receiving labels dispensed from said label dispenser and providing them to the proximal end of said label carrier.

3. The corner labeler as recited in claim 1, wherein said transport drive comprises a vacuum belt transport having first and second rollers and an endless belt extending around said rollers, one of said rollers comprising a drive roller for rotatably driving said belt, a region of the endless belt between said rollers on one side of said rollers being adapted to receive labels to be applied to said articles, said vacuum belt transport further comprising means for providing vacuum pressure at said region of said belt to hold labels on said region of the belt.

4. The corner labeler as recited in claim 3, wherein said vacuum belt transport further comprises a scoop, a wiping roller and a wiping brush at said distal end, the scoop being disposed to provide a surface bridging a distal end of said belt at the second roller and said wiping roller so that the labels move from a distal end of the belt onto and over said wiping roller without becoming entangled therein, the wiping roller being adapted to wipe down a first portion of a label onto the front surface of an article in the labeling station, and the wiping brush being adapted to wipe down a second portion of the label onto the proximal side surface of the article, such that the wiping roller and the wiping brush together function to properly adhere the label onto the article.

5. The corner labeler as recited in claim 3, wherein said vacuum belt transport comprises a shuttle frame, said shuttle frame supporting said rollers and said belt, and being pivotally mounted at a proximal end thereof, so that the shuttle frame is pivotable between a home position and an armed position.

6. The corner labeler as recited in claim 5, wherein said shuttle frame is also axially translatable between a proximal label receiving position and a distal label applying position.

7. The corner labeler as recited in claim 5, wherein a force is applied to said shuttle frame to bias it to the home position.

8. The corner labeler as recited in claim 7, wherein a timing belt actuated by a pneumatic cylinder applies said biasing force.

9. The corner labeler as recited in claim 7, and further comprising a means responsive to the passing of a rear edge of an article through the label applying station for actuating said shuttle frame to its axially extended label applying position.

10. The corner labeler as recited in claim 9, wherein the shuttle frame, in its extended label applying position, is adapted to be impacted by the front side of an article entering the label applying station, so that a first portion of a label extending across a wiping roller at the distal end of the shuttle frame is applied to said article front side and continued advancement of the article through the labeling station overcomes the force biasing to the home position and pivots the shuttle frame from the home position against the biasing force to the armed position.

11. The corner labeler as recited in claim 10, and further comprising a switch actuated by said shuttle frame as it pivots to the armed position, said switch actuating the shuttle frame to retract axially from the label applying position to the label receiving position, the axial translation of the shuttle frame from the label applying position to the label receiving position functioning to cause the wiping roller to wipe the first portion of the label down against the forward side of the article.

12. The corner labeler as recited in claim 11, wherein the biasing force returns the shuttle frame to the home position when said frame has retracted sufficiently to no longer be contacted by the front face of the article, the pivotal return motion of the shuttle frame functioning to cause the wiping brush to wipe a second portion of the label about said corner and against the proximal side of the article.

13. A high speed corner labeler for applying labels to articles having a front side, a proximal side, and a corner joining said front and proximal sides, wherein said articles are conveyed through a labeling station, said labeler comprising:

a label dispenser for dispensing adhesive-backed labels for application to each of said articles;

a label carrier comprising a vacuum belt transport having first and second rollers and an endless belt extending around said rollers, one of said rollers comprising a drive roller for rotatably driving said belt, a region of the endless belt between said rollers on one side of said rollers being adapted to receive labels to be applied to said articles, said vacuum belt transport further comprising a means for providing vacuum pressure at said region of the belt to hold labels on said region of the belt and being supported by a shuttle frame; and a chute disposed between said label dispenser and said label carrier, for receiving labels dispensed from said label dispenser and providing them to the proximal end of said label carrier;

wherein said shuttle frame is pivotable between a home position and an armed position, and is also axially translatable between a retracted label receiving position, where a proximal end of said vacuum belt transport is closely adjacent to a distal end of said chute, for receiving a label from said chute, to an extended label applying position, wherein a distal end of said label carrier contacts a side of an article passing through said labeling station, to thereby apply a label to the article.

14. The corner labeler as recited in claim 13, wherein a label may be dispensed and retained on the chute until the shuttle frame returns to its retracted label receiving position.

15. The corner labeler as recited in claim 13, wherein a label may be received by the proximal end of the vacuum belt transport while another label is simultaneously being applied to an article.

16. The corner labeler as recited in claim 13, and further comprising an air jet nozzle disposed to direct a stream of air toward said chute, such that said stream of air holds the labels against the chute.

17. The corner labeler as recited in claim 13, wherein a force is applied to said shuttle frame to bias it to the home position.

18. The corner labeler as recited in claim 17, and further comprising a means responsive to the passing of a rear edge of an article through the label applying station for actuating said shuttle frame to its axially extended label applying position.

19. The corner labeler as recited in claim 18, wherein the shuttle frame, in its extended label applying position, is adapted to be impacted by the front side of an article entering the label applying station, so that a first portion of a label extending across a wiping roller at the distal end of the shuttle frame is applied to said article front side and continued advancement of the article through the labeling station overcomes the force biasing to the home position and pivots the shuttle frame from the home position against the biasing force to the armed position.

20. The corner labeler as recited in claim 19, and further comprising a switch actuated by said shuttle frame as it enters the armed position, said switch actuating the shuttle frame to retract axially from the label applying position to the label receiving position, the axial translation of the shuttle frame from the label applying position to the label receiving position functioning to cause the wiping roller to wipe the first portion of the label down against the forward side of the article.

21. The corner labeler as recited in claim 20, wherein the biasing force returns the shuttle frame to the home position when said frame has retracted sufficiently to no longer be contacted by the front face of the article, the pivotal return motion of the shuttle frame functioning to cause the wiping brush to wipe a second portion of the label about said corner and against the proximal side of the article.

22. A high speed corner labeler for applying labels to articles having a front side, a proximal side, and a corner joining said front and proximal sides, wherein said articles are conveyed through a labeling station, said labeler comprising:

a label dispenser for dispensing adhesive-backed labels for application to each of said articles;

a label carrier comprising a vacuum belt transport for transporting each label from a proximal end to a distal end of the label carrier, said label carrier having first and second rollers and an endless belt extending around said rollers, one of said rollers comprising a drive roller for rotatably driving said belt, a region of the endless belt between said rollers on one side of the rollers being adapted to receive labels to be applied to said articles, said vacuum belt transport further comprising a means for providing vacuum pressure at said region of the belt to hold labels on said region of the belt and being supported by a shuttle frame, the label carrier having a label receiving position and a label applying position, and being adapted to apply a single label to the front and proximal sides of each article as it is conveyed through said labeling station, such that the label is wrapped about said corner;

a chute disposed between said label dispenser and said label carrier, for receiving labels dispensed from said label dispenser and providing them to the proximal end of said label carrier;

said labeling station being disposed at the distal end of the label carrier;

said shuttle frame being pivotable between a home position and an armed position, and being axially translatable between a retracted label receiving position, where a proximal end of said vacuum belt transport is closely adjacent to a distal end of the chute, for receiving a label from the chute, to an extended label applying position, wherein a distal end of the label carrier contacts a side of an article passing through the labeling station, to thereby apply a label to the article;

wherein the labeler is adapted so that a label may be dispensed from said label dispenser while another label is simultaneously applied to an article passing through the labeling station, thereby increasing the labeling speed of the labeler.

* * * * *